US009587827B2

(12) United States Patent
Wells et al.

(10) Patent No.: US 9,587,827 B2
(45) Date of Patent: Mar. 7, 2017

(54) WATER COOLED CO BOILER FLOOR WITH SCREEN GAS DISTRIBUTION INLET

(71) Applicant: Babcock & Wilcox Power Generation Group, Inc., Barberton, OH (US)

(72) Inventors: Eric L Wells, Massillon, OH (US); John A Kulig, Barberton, OH (US); Daniel E Knopsnider, Jr., Akron, OH (US); Richard A Wessel, Massillon, OH (US)

(73) Assignee: The Babcock & Wilcox Company, Barberton, OH (US)

( * ) Notice: Subject to any disclaimer, the term of this patent is extended or adjusted under 35 U.S.C. 154(b) by 365 days.

(21) Appl. No.: 13/949,200

(22) Filed: Jul. 23, 2013

(65) Prior Publication Data

US 2014/0202400 A1 Jul. 24, 2014

Related U.S. Application Data

(60) Provisional application No. 61/692,495, filed on Aug. 23, 2012.

(51) Int. Cl.

| | |
|---|---|
| ***F23G 7/06*** | (2006.01) |
| ***F22B 21/34*** | (2006.01) |
| ***F22B 1/18*** | (2006.01) |

(52) U.S. Cl.

CPC ..... *F23G 7/065* (2013.01); *F22B 1/1861* (2013.01); *F22B 21/345* (2013.01)

(58) Field of Classification Search

CPC ..... F22B 1/1861; F22B 21/345; F22G 7/065
USPC ..... 122/7 D, 7 R, 6 R, 6 A, 6 C, 7 B, 9, 122/235.12, 235.22, 235.24, 235.25
See application file for complete search history.

(56) References Cited

U.S. PATENT DOCUMENTS

| | | | | |
|---|---|---|---|---|
| 1,992,953 A * | 3/1935 | Kerr | F22B 21/00 | 122/235.11 |
| 3,119,440 A * | 1/1964 | Cruise | F22B 21/345 | 122/7 C |
| 5,381,741 A * | 1/1995 | Ostlie | F22B 37/146 | 110/234 |
| 5,730,071 A * | 3/1998 | Wasyluk | F23M 9/10 | 110/210 |

(Continued)

OTHER PUBLICATIONS

Durham, E. et. al., Design and Application of CO Boilers, Presented to Sabine Section of American Society of Mechanical Engineers, Mar. 7, 1956, pp. 16, The Babcock & Wilcox Company, Boiler Division, Port Arthur, Texas.

(Continued)

*Primary Examiner* — Alissa Tompkins
*Assistant Examiner* — Benjamin W Johnson
(74) *Attorney, Agent, or Firm* — Michael J. Seymour

(57) ABSTRACT

A carbon monoxide (CO) boiler or steam generator having a water cooled CO boiler floor with screen gas distribution inlet to enhance distribution of CO gas in a CO boiler. Either the front or rear wall tubes of the steam generator form an integral screen and the tubes continue, forming a membraned, gas tight enclosure. The floor has a "knee" to redirect the incoming waste CO gas up into the integral screen. The screen may be provided with tube erosion shields to prevent erosion of the screen tubes and to control the distribution of waste gas across the plan area of the furnace.

10 Claims, 7 Drawing Sheets

(56) References Cited

U.S. PATENT DOCUMENTS

| | | | | |
|---|---|---|---|---|
| 6,178,924 | B1 * | 1/2001 | Hakulinen | D21C 11/12 122/235.33 |
| 7,434,543 | B2 * | 10/2008 | Raukola | D21C 11/12 122/461 |
| 2006/0016402 | A1 * | 1/2006 | Harth, III | F16L 55/035 122/511 |

OTHER PUBLICATIONS

"Steam: its generation and use", 41st Edition, The Babcock & Wilcox Company, ISBN 0-9634570-1-2, Chapter 27, 2005.

* cited by examiner

ELEVATION
CIRCULAR FURNACE BOILER

CIRCULAR FURNACE BOILER

Plots are at the Furnace Center Vertical Plane

WATER COOLED CO BOILER FLOOR WITH SCREEN GAS DISTRIBUTION INLET

RELATED APPLICATION DATA

This patent application claims priority to U.S. Provisional Patent Application No. 61/692,495 filed Aug. 23, 2012 and titled "WATER COOLED CO BOILER FLOOR WITH SCREEN GAS DISTRIBUTION INLET." The complete text of this application is hereby incorporated by reference as though fully set forth herein in its entirety.

BACKGROUND

The present disclosure relates in general, to the field of carbon monoxide (CO) boilers. More particularly, the present disclosure is directed to a water cooled CO boiler floor with screen gas distribution inlet.

CO boilers are installed in the exhaust gas stream of fluid catalytic cracking units, which are comprised of a reactor and a regenerator. CO boilers are integral parts of the fluid cracking units, but they may be arranged so that the CO boiler could be operated independently, or taken out of service, without affecting the operation of the cracking unit.

Finely divided catalyst suspended in the gaseous vapors flows continuously in a cycle from the reactor to the regenerator and back to the reactor in fluid catalytic cracking units. Gas oil feed stock is injected into the hot regenerated catalyst line just before it enters the reactor. Hydrocarbon vapors leave the reactor through cyclone separators, which return the entrained catalyst to the reactor bed, and the cracked petroleum products are separated in the fractionator.

In the reactor, the catalyst accumulates a carbonaceous deposit. The spent, or carbon coated catalyst, is transported to the regenerator by injecting compressed air into the catalyst stream. Additional air is supplied to the regenerator directly to burn the carbon from the catalyst. The heat of combustion is absorbed by the regenerator catalyst, which, in turn, heats the oil feed stock to effect vaporization. The oil vapors and catalyst are then discharged into the reactor to begin the cracking and refining process.

The CO gases are discharged from the regenerator through cyclone separators, to remove as much of the entrained catalyst as possible before they enter the CO boiler for heat recovery prior to their discharge to the atmosphere. However, catalyst particles may remain mixed with the CO gases. The problem with these catalyst particles is that they are abrasive and can erode and damage the tubes as these CO gases and entrained catalyst pass across the tubes.

The CO boiler was developed to recover the heat discharged from the catalytic regenerator. Please refer to FIGS. 1*a* and 1*b*. FIG. 1*a* illustrates a side and plan view of a prior art elevation circular CO boiler. FIG. 1*b* illustrates a side view of another prior art top supported circular CO boiler with an integrated bustle. The combustible content of the gas stream is the result of the incomplete burning of the carbon at low temperature with, in most instances, a deficiency of air. The unburned combustibles consist primarily of carbon monoxide with some traces of entrained hydrocarbons. In catalytic crackers, it is desirable to burn off the carbon to produce a maximum of CO instead of $CO_2$ since a cubic foot of air combines with twice the amount of carbon when as CO is made.

CO boilers are especially designed to obtain complete burning of the combustibles in the CO gas stream. The primary furnace is the critical part of a CO boiler from a combustion point of view because this is where the CO gas, the supplementary fuel and combustion air must be thoroughly mixed and burned.

The furnaces, both secondary and primary, and the boiler tube bank are designed as a single integrated boiler unit supported at the top, with provision for downward expansion. As shown in FIG. 1*b*, the primary furnace is below the bustle and the secondary furnace is above the bustle.

The supplementary fuel burners, and the CO gas nozzles are arranged for tangential firing to make the gases swirl, thus thoroughly mixing them to promote rapid and complete burning. Since CO boilers are often located at refineries, the supplementary fuel is usually refinery gas. The fuel burners are arranged in a staggered pattern with respect to the CO gas nozzles. The wall tubes are covered with refractory to minimize radiant heat absorption, thus facilitating the burning of the CO gas with a minimum amount of supplementary fuel. The wall tubes also cool the refractory, thus protecting the refractory material when firing only supplementary fuel.

The CO gas and combustion air windboxes or distribution chambers are designed as an integral part of the furnace. This provides a simple water cooled arrangement for the high temperature CO gases and eliminates difficult and expensive differential expansion and seal problems.

The secondary furnace, located immediately above the primary furnace, provides extra space for completing the combustion of the fuel and for radiant heat absorption. The economizer for preheating the boiler feedwater is located above the boiler, thus occupying a minimum of ground space.

A superheater is used to raise the steam temperature beyond the saturation point by transferring heat from the hot gases to the steam conveyed within the superheater tubes. An attemperator is used to regulate the steam temperature.

The CO gas plenum is a pressurised housing containing the CO gas at positive pressure and delivers the CO gas into the primary furnace. Forced-draft fans supply air for combustion.

To provide for the independent operation of the CO boiler without interfering with the operation of the regenerator, water seal tanks are installed so that the CO gases from the regenerator may be directed through the boiler or bypassed around the boiler directly to the stack.

Waste gas CO inlet ducts are typically arranged with adequate straight length for uniform gas distribution. The problem occurs when space and overall CO waste gas steam generator height and volume are limited, which may cause problems with adequate and effective incineration and steam generator performance.

Given the above, a need exists for a new and improved CO boiler, and in particular a CO boiler that provides adequate and effective incineration and steam generator performance in limited space while overcoming the problems associated with catalyst particles, which remains of significant commercial interest in the industry.

BRIEF DESCRIPTION

Complete burning of combustibles in the CO gas stream is desired and very important in CO boilers.

The present disclosure thus relates, in various embodiments, to a CO boiler or steam generator having a water cooled CO boiler floor with screen gas distribution inlet to enhance distribution of CO gas in a CO boiler.

Effective incineration of CO gas in a CO boiler requires uniform distribution of the waste CO gas across the furnace plan area. The problem of space limitation, including, but not limited to, overall CO waste gas steam generator height and volume, causing problems with adequate and effective incineration and steam generator performance are solved by a water cooled CO boiler that uses either the front or rear wall tubes of the steam generator to form an integral screen for redirecting the incoming waste CO gas and an enhanced and more uniform distribution of the CO gas. The front or rear wall tubes continue beyond the screen, forming a membraned, gas tight enclosure. The water cooled CO boiler floor with screen gas distribution inlet (also known as the floor) has a "knee" to redirect the incoming waste CO gas up into the integral screen.

In one embodiment, the tubes forming the screen are separated from one another, forming gaps between adjacent tubes, through which the CO gas is conveyed into the primary or lower portion of the CO boiler furnace. The tubes may be substantially planar or they may be staggered out of plane with respect to one another. By selecting the dimensions of these gaps, and/or their location along the length of the tubes and across the furnace plan area, an enhanced and more uniform distribution of the CO gas for nearly complete burning is achieved in a limited space and furnace volume.

The problem with the catalyst particles being abrasive and causing erosion and damage to the tubes as the CO gases and entrained catalyst pass across the tubes is solved by the screen being provided with tube erosion shields to prevent erosion of the screen tubes and to control the distribution of waste CO gas across the plan area of the furnace.

The arrangement of screen tubes allows delivery and redirection of the CO gas to conform to the available space, even with limited physical building volume, and produce acceptable CO gas distribution for adequate incineration and steam generator performance. The proposed arrangement is thus especially suited for applications where space is limited, but demands for uniform CO gas distribution are required. By using tubes to provide the integral CO gas distribution screen, there is also a reduced tendency for temperature distortion and degradation.

Accordingly, one aspect of the present invention is drawn to a carbon monoxide (CO) boiler, comprising: a furnace enclosure having front, rear and side walls made of membraned tubes; a CO gas conduit for conveying CO gas into the furnace enclosure; a water cooled CO boiler floor with screen gas distribution inlet, the floor made of tubes forming a front wall of the furnace enclosure separated from one another and without membrane therebetween to form an integral screen provided with an arrangement of gaps or apertures between adjacent tubes for conveying CO gas therethrough into the furnace enclosure; and a knee formed of membraned furnace enclosure tubes made of tubes forming a front wall of the furnace enclosure for redirecting incoming CO gas upwardly through the water cooled CO boiler floor with screen gas distribution inlet into the furnace enclosure.

Another aspect of the present invention is drawn to a water cooled carbon monoxide (CO) boiler floor with screen gas distribution inlet, comprising a floor made of tubes forming a front wall of the furnace enclosure separated from one another and without membrane therebetween to form an integral screen provided with an arrangement of gaps or apertures between adjacent tubes for conveying CO gas therethrough into the furnace enclosure; and a knee formed of membraned furnace enclosure tubes made of tubes forming a front wall of the furnace enclosure for redirecting incoming CO gas upwardly through the water cooled CO boiler floor with screen gas distribution inlet into the furnace enclosure.

The water cooled CO boiler floor with a screen gas distribution inlet can be used on both existing unit upgrades and new CO boiler applications.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which exemplary embodiments of the invention are illustrated. These and other non-limiting aspects and/or objects of the disclosure are more particularly described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1A:
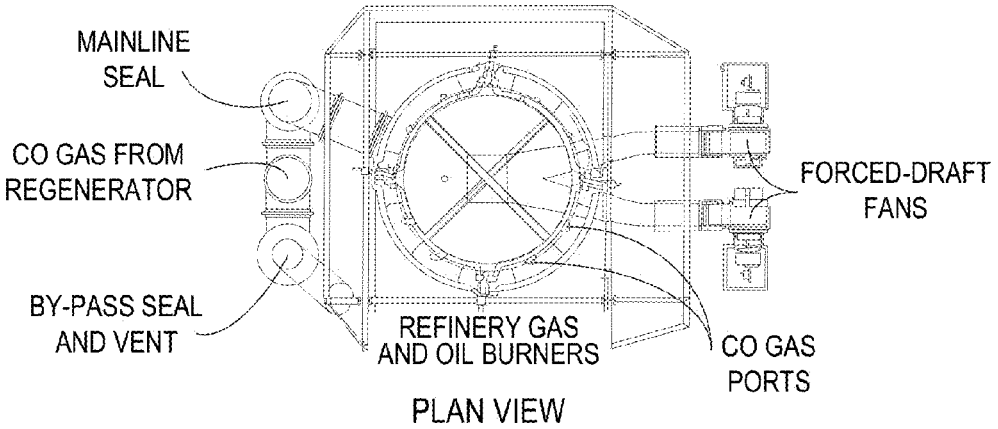
FIG. 1A PRIOR ART
FIG. 1*a* illustrates a side and plan view of a prior art CO boiler.
Figure 1A:
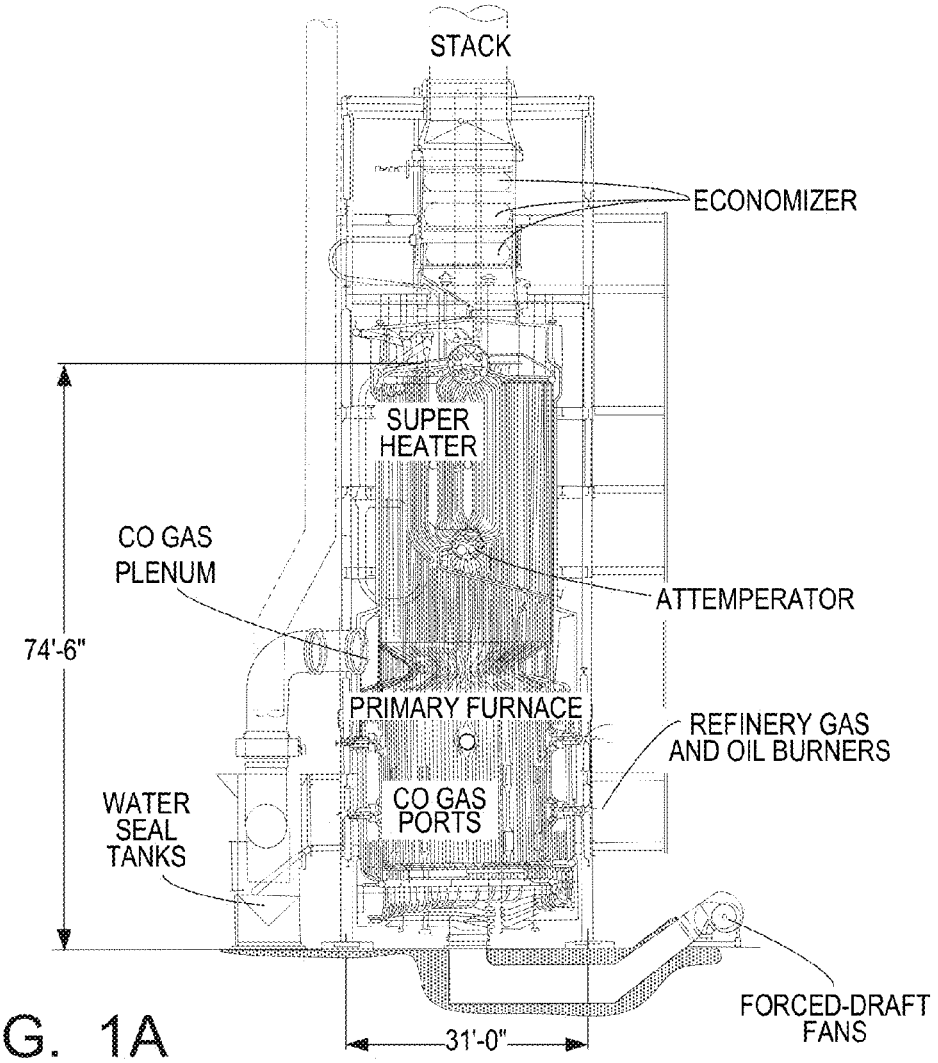
FIG. 1A PRIOR ART
Figure 1B:
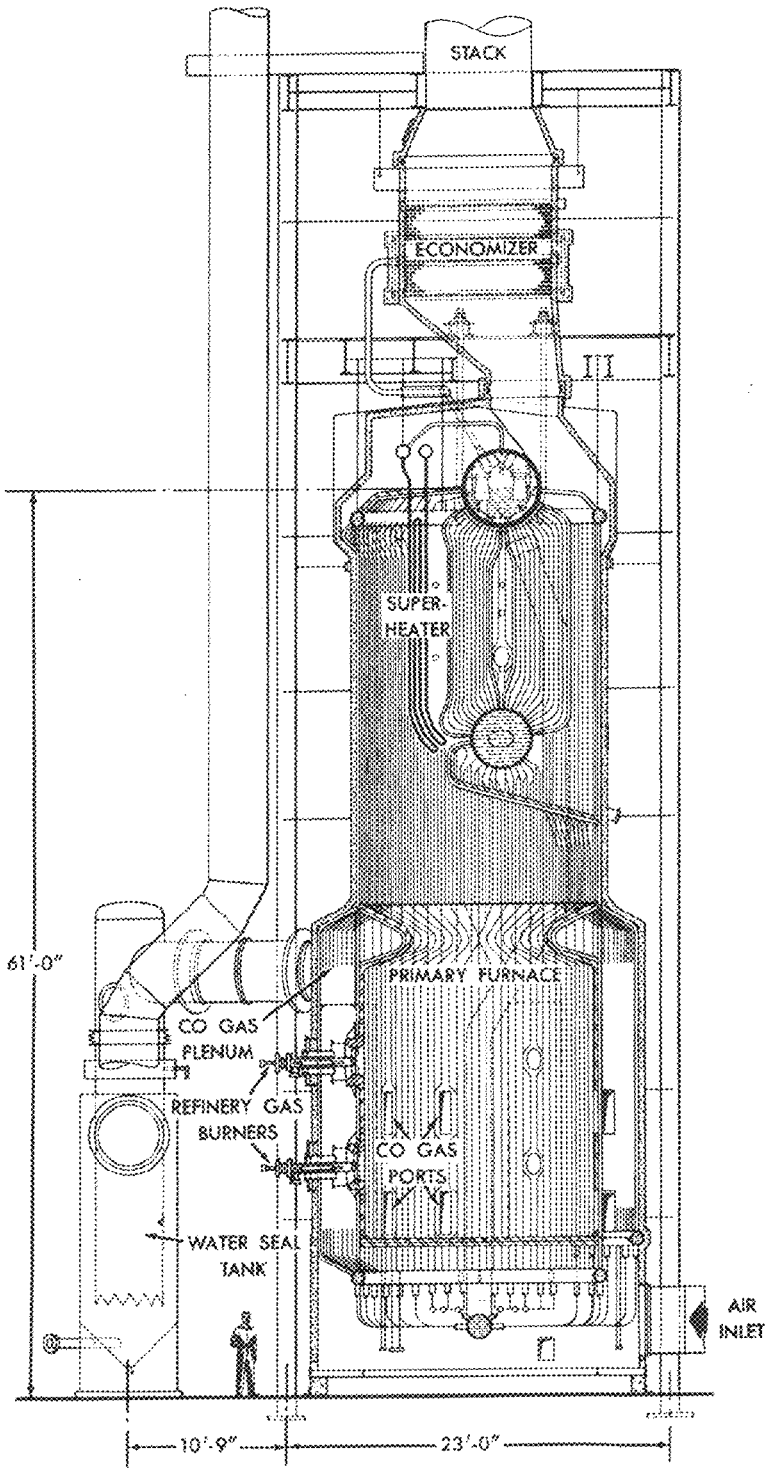
FIG. 1B PRIOR ART
FIG. 1*b* illustrates a side view of another prior art CO boiler.

A more complete understanding of the processes and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

It should be noted that many of the terms used herein are relative terms. For example, the terms "inlet" and "outlet" are relative to a direction of flow, and should not be construed as requiring a particular orientation or location of the structure. Similarly, the terms "upper" and "lower" are relative to each other in location, i.e. an upper component is located at a higher elevation than a lower component.

It should be noted that many of the terms used herein are relative terms. For example, the terms "front", "rear", and "side" are relative to a center, and should not be construed as requiring a particular orientation or location of the structure. Furthermore, for example, the water cooled CO boiler floor screen gas distribution inlet may use the tubes forming the rear wall of the steam generator to form an integral screen, separated from one another and without membrane therebetween and the tubes may continue upward as membraned tubes in the rear wall to form the membraned, gas tight enclosure.

The term "vertical" is used to indicate direction relative to an absolute reference, i.e. ground level. However, these terms should not be construed to require structures to be absolutely parallel or absolutely perpendicular to each other. For example, a first vertical structure and a second vertical structure are not necessarily parallel to each other.

The term "plane" is used herein to refer generally to a common level, and should be construed as referring to a volume, not as a flat surface.

As is known to those skilled in the art, heat transfer surfaces which convey steam-water mixtures are commonly referred to as evaporative boiler surfaces; heat transfer surfaces which convey steam therethrough are commonly referred to as superheating (or reheating, depending upon the associated steam turbine configuration) surfaces. Regardless of the type of heating surface, the sizes of the tubes, their material, diameter, wall thickness, number, and arrangement are based upon temperature and pressure for service, according to applicable boiler design codes, such as the American Society of Mechanical Engineers (ASME) Boiler and Pressure Vessel Code, Section I, or equivalent other codes as required by law.

To the extent that explanations of certain terminology or principles of the heat exchanger, boiler, and/or steam generator arts may be necessary to understand the present disclosure, and for a more complete discussion of CO boilers, or of the design of modern utility and industrial boilers, the reader is referred to the reader is referred to *Steam/its generation and use,* 41$^{st}$ Edition, Kitto and Stultz, Eds., Copyright © 2005, The Babcock & Wilcox Company, Barberton, Oh., U.S.A., the text of which is hereby incorporated by reference as though fully set forth herein.

The present disclosure relates to a water cooled CO boiler floor with screen gas distribution inlet, and to a CO boiler or steam generator provided with same. While the following discussion will use the term "water cooled CO boiler floor" for the sake of convenience, it will be appreciated by those of skill in the art that the fluid conveyed through the tubes of the apparatus disclosed herein may be water, steam or a mixture of water/steam mixture.

In the present invention, the circular CO boiler is modified from a round design to a square design boiler. The primary and secondary furnaces are combined into one furnace. By converting the round boiler design to a square boiler design, there is a potential loss of high mixing rates of the CO gas from the tangential input CO ports. Therefore, the CO ports go from tangential inlets on the sidewalls to flow from the floor. By flowing the CO gas from the floor, there is potential for space limitations, lack of mixing and maldistribution of gases, and interference of the CO gas to the auxiliary burners, but not limited thereto. Hence, the need for a water cooled CO boiler that uses either the front or rear wall tubes of the steam generator to form an integral screen for redirecting the incoming waste CO gas and an enhanced and more uniform distribution of the CO gas. The present invention is not intended to be limited to a round or square design boiler, nor a CO boiler with only one furnace, but one skilled in the art would recognize that the present invention may be used in any CO boiler design.

Figure 2:
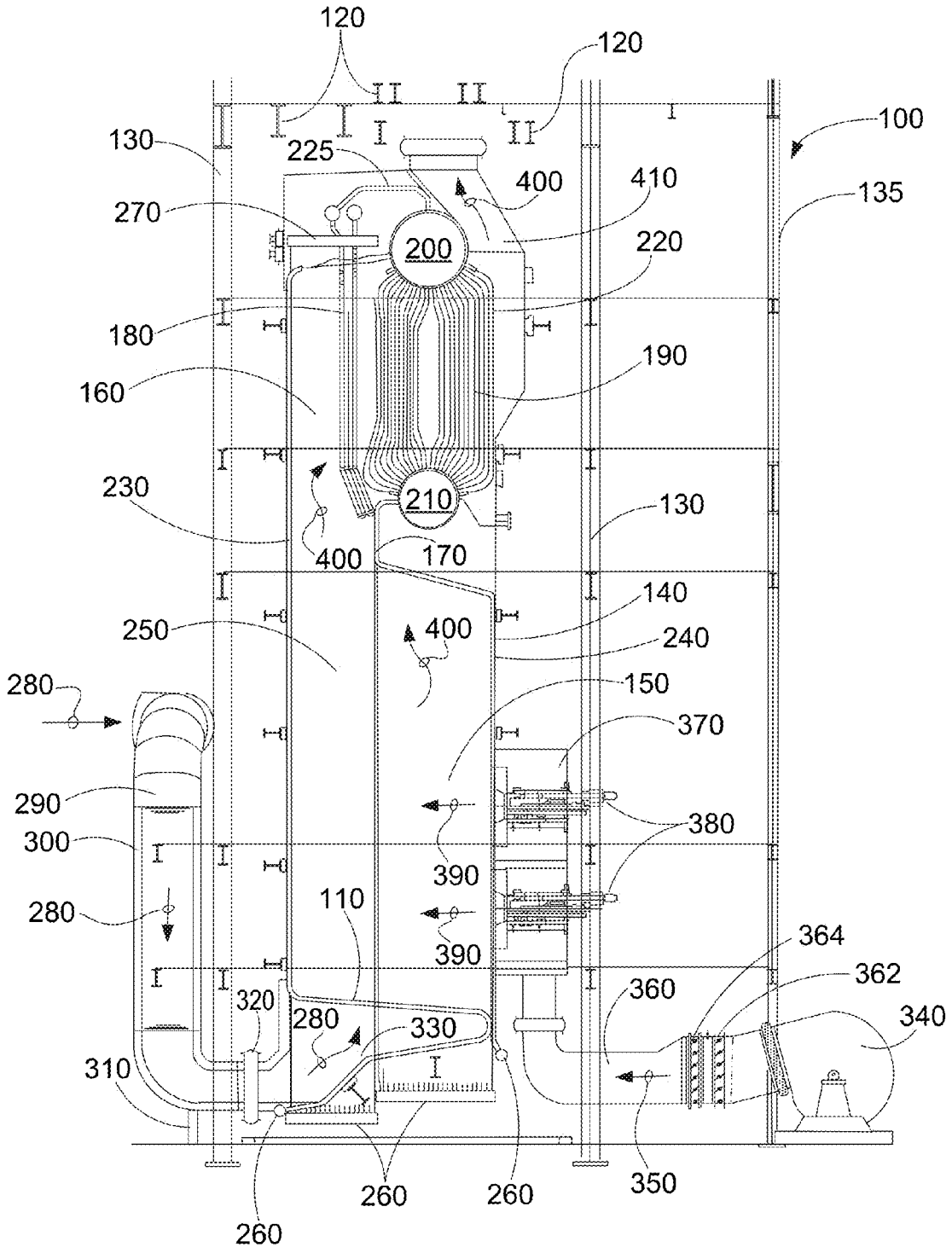
FIG. 2 illustrates a side view of an embodiment of a CO boiler having a water cooled CO boiler floor with a screen gas distribution inlet according to one embodiment of the present disclosure.

Referring to the drawings generally, wherein like reference numerals designate the same or functionally similar elements throughout the several drawings, and to FIG. 2 in particular, there is illustrated a side view of an embodiment of a CO boiler, generally designated 100, having a water cooled CO boiler floor screen gas distribution inlet 110 according to one embodiment of the present disclosure. The CO boiler 100 is top-supported from structural steel members 120, which are, in turn, supported by an arrangement of structural steel columns 130.

The CO boiler 100 is provided with a gas-tight furnace enclosure 140 having an all welded membraned tube construction. The tubes used in the furnace enclosure 140 may be smooth internal surfaces, or they may be provided with ribs, such as single-lead rib tubes (SLR tubes) or multiple lead rib (MLR) tubes as required to prevent departure from nucleate boiling or DNB. Furnace enclosure 140 is comprised of a lower or primary furnace portion 150 and an upper or secondary furnace portion 160. A furnace arch 170 is located roughly at the transition region between the primary 150 and secondary 160 furnace portions, and serves to redirect the gases from the primary furnace 150 across heating surfaces located in the secondary furnace portion 160.

These heating surfaces include a superheater bank 180, followed by a generating or evaporative boiler bank 190. Boiler bank 190 is of a two-drum design, having an upper steam drum 200, and a lower or "mud" drum 210, interconnected by a plurality of tubes 220. Boiler feedwater conveyed to the steam drum 200 circulates by natural convection between the steam drum 200 and mud drum 210 through the tubes 220 and is transformed into a water/steam mixture. Separators (not shown) in the steam drum 200 separate the steam from the water and saturated connections 225 convey the steam to the superheater bank 180 to produce superheated steam. The separated water is returned to the mixture circulating between the drums via the tubes 220.

The furnace enclosure 140 is comprised of a front wall 230, rear wall 240, and side walls 250. Inlet and outlet headers 260, 270, respectively, are provided as shown and serve as distribution and collection points for the water and water/steam mixtures conveyed through the tubes forming the walls of the furnace enclosure 140.

Hot CO gas 280 is conveyed by a gas conduit 290, insulated with refractory 300 to reduce heat loss, into the building enclosure 135. Conduit 290 may be bottom-supported at 310; expansion joint 320 accommodates relative thermal expansion between the conduit 290 and the furnace enclosure 140.

Upon entry into the furnace enclosure 140, the CO gas 280 impinges against a knee 330 formed of membraned furnace enclosure tubes and is redirected upwardly into and through the water cooled CO boiler floor screen gas distribution inlet 110.

The water cooled CO boiler floor screen gas distribution inlet 110 is provided with an arrangement of gaps or apertures between adjacent tubes which serve to more uniformly distribute and admit the CO gas 280 across the plan area of the lower or primary furnace 150. As illustrated in FIG. 2, the water cooled CO boiler floor screen gas distribution inlet 110 uses the tubes forming the front wall of the steam generator 100 to form an integral screen, separated from one another and without membrane therebetween. The tubes then continue upward as membraned tubes in the front wall 230 to form the membraned, gas tight enclosure. The portion of the front wall tubes forming the knee 330 located below the water cooled CO boiler floor screen gas distribution inlet 110 are also membraned.

The tubes may be substantially planar or they may be staggered out of plane with respect to one another. By selecting the dimensions of the gaps or apertures provided by the tubes forming the water cooled CO boiler floor screen gas distribution inlet 110, and/or their location along the length of the tubes and across the furnace plan area, an enhanced and more uniform distribution of the CO gas for nearly complete burning is achieved in a limited space and furnace volume.

The arrangement of screen tubes allows delivery and redirection of the CO gas to conform to the available space, even with limited physical building volume, and produce acceptable CO gas distribution for adequate incineration and steam generator performance. The proposed arrangement is thus especially suited for applications where space is limited, but demands for uniform CO gas distribution are required. By using tubes to provide the integral CO gas distribution screen, there is also a reduced tendency for temperature distortion and degradation.

In order to combust the CO gas 280, air and supplementary fuel is also provided to the CO boiler 100. Forced-draft (FD) fan 340 provides combustion air 350 via duct 360, tight shut-off damper 362 and control damper 364 to a windbox 370. Located therein are one or more burners 380, which combine the air 350 with the supplementary fuel (e.g., refinery gas) to create combustion products 390 in the primary furnace 150. CO gas 280 distributed therein by the water cooled boiler floor 110 is ignited by these combustion products 390, thereby depleting the CO content and reducing the CO eventually emitted from the unit. The flue gases 400 resulting from the combustion of the CO gas 280 and supplementary fuel are conveyed up through the secondary furnace 160, across the heating surfaces located therein, and out an exit flue 410 to a stack (not shown).

Figure 3:
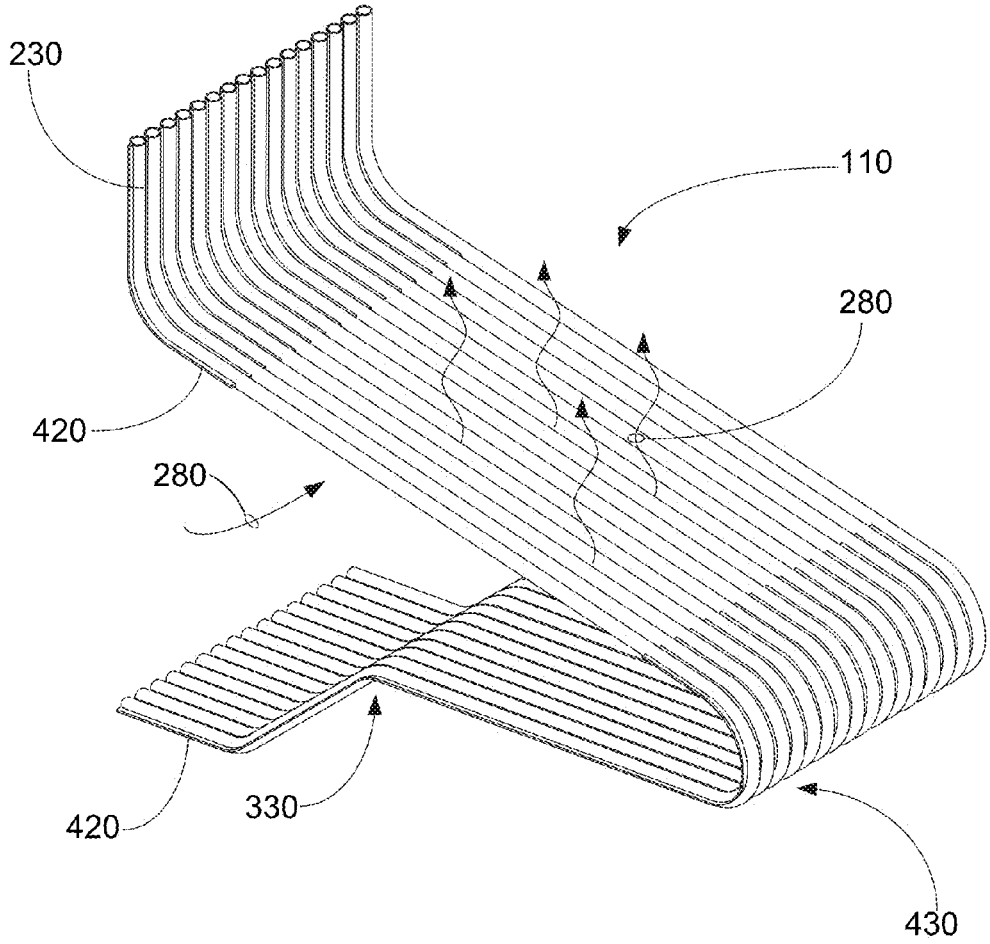
FIG. 3 illustrates a perspective view of an embodiment of the water cooled CO boiler floor screen gas distribution inlet of FIG. 2.

Referring now to FIG. 3, there is shown a perspective view of an embodiment of the water cooled CO boiler floor screen gas distribution inlet 110 of FIG. 2. As previously described, incoming CO gas 280 impacts the knee 330 and is redirected up through gaps in the water cooled CO boiler floor screen gas distribution inlet 110. Membrane 420 is provided at other locations to provide a gas-tight construction. The tubes forming the knee 330 continue on towards the rear wall 240 (see FIG. 2) and bend at a nose portion 430, then continue onwards toward the front wall 230 to form the water cooled CO boiler floor screen gas distribution inlet 110.

Figure 4:
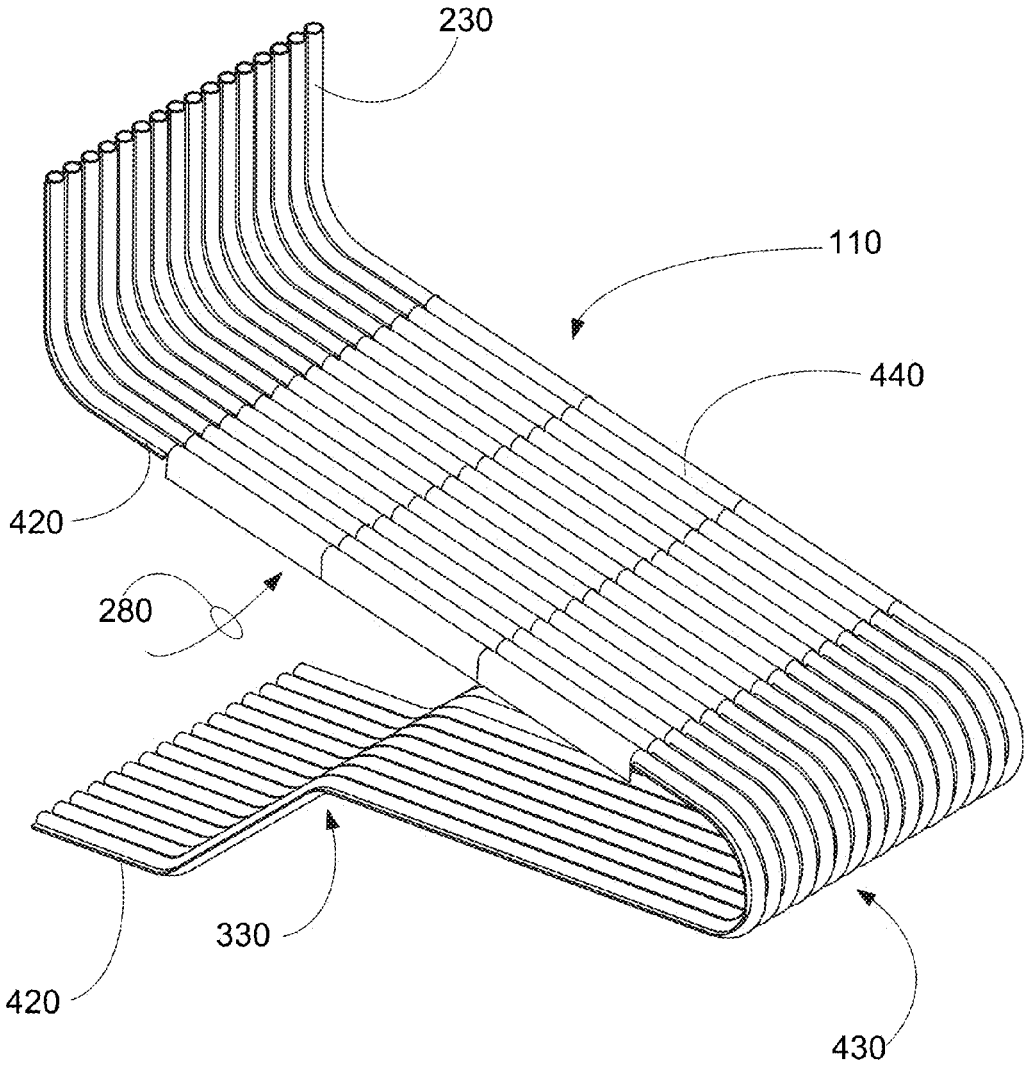
FIG. 4 illustrates a perspective view of another embodiment of the water cooled CO boiler floor screen gas distribution inlet of FIG. 3, provided with erosion shields.

Referring now to FIG. 4, there is shown a perspective view of another embodiment of the water cooled CO boiler floor screen 110 of FIG. 3, provided with tube erosion shields 440. The tube erosion shields 440 may advantageously be made of stainless steel to withstand the high gas temperature environment they will be exposed to in service. The tube erosion shields 440 reduce or prevent erosion of the tubes forming the water cooled CO boiler floor screen gas distribution inlet 110 and also serve to control the distribution of the CO gas 280 across the plan area of the furnace by providing a desired location and flow area for the CO gas 280 therethrough.

Figure 5:
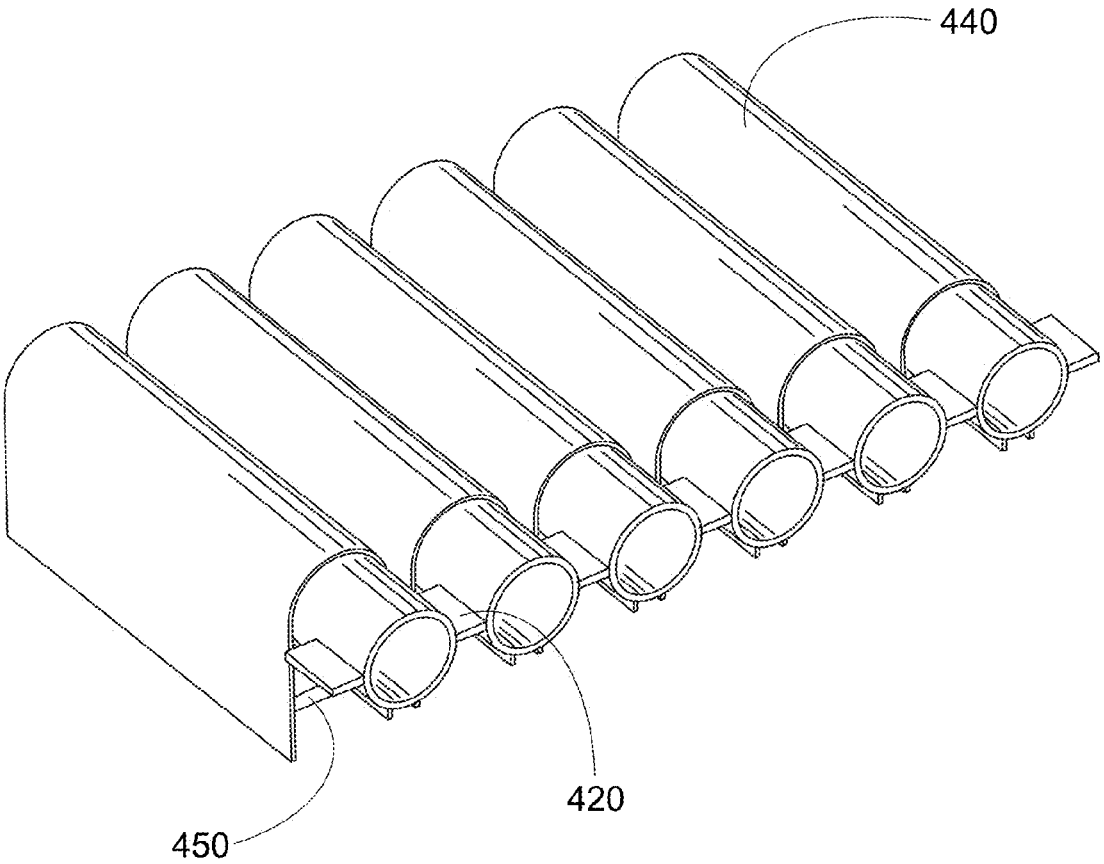
FIG. 5 illustrates a perspective view, in section, of the water cooled CO boiler floor screen gas distribution inlet of FIG. 4.

Referring now to FIG. 5, there is shown a perspective view, in section, of the water cooled CO boiler floor screen gas distribution inlet 110 of FIG. 4. This figure illustrates the construction at either the start or end of the tube erosion shields 440 at the front wall 230, or near the rear wall 240 (adjacent the nose portion 430). A bar 450 may advantageously be applied to sides of the tube erosion shields 440 on the underside of the tubes forming water cooled CO boiler floor screen gas distribution inlet 110 to secure them in place. Alternatively, this figure illustrates how short pieces of membrane 420 may be used in between multiple, individual tube erosion shields 440 on a given tube to prevent vibration.

Figure 6:
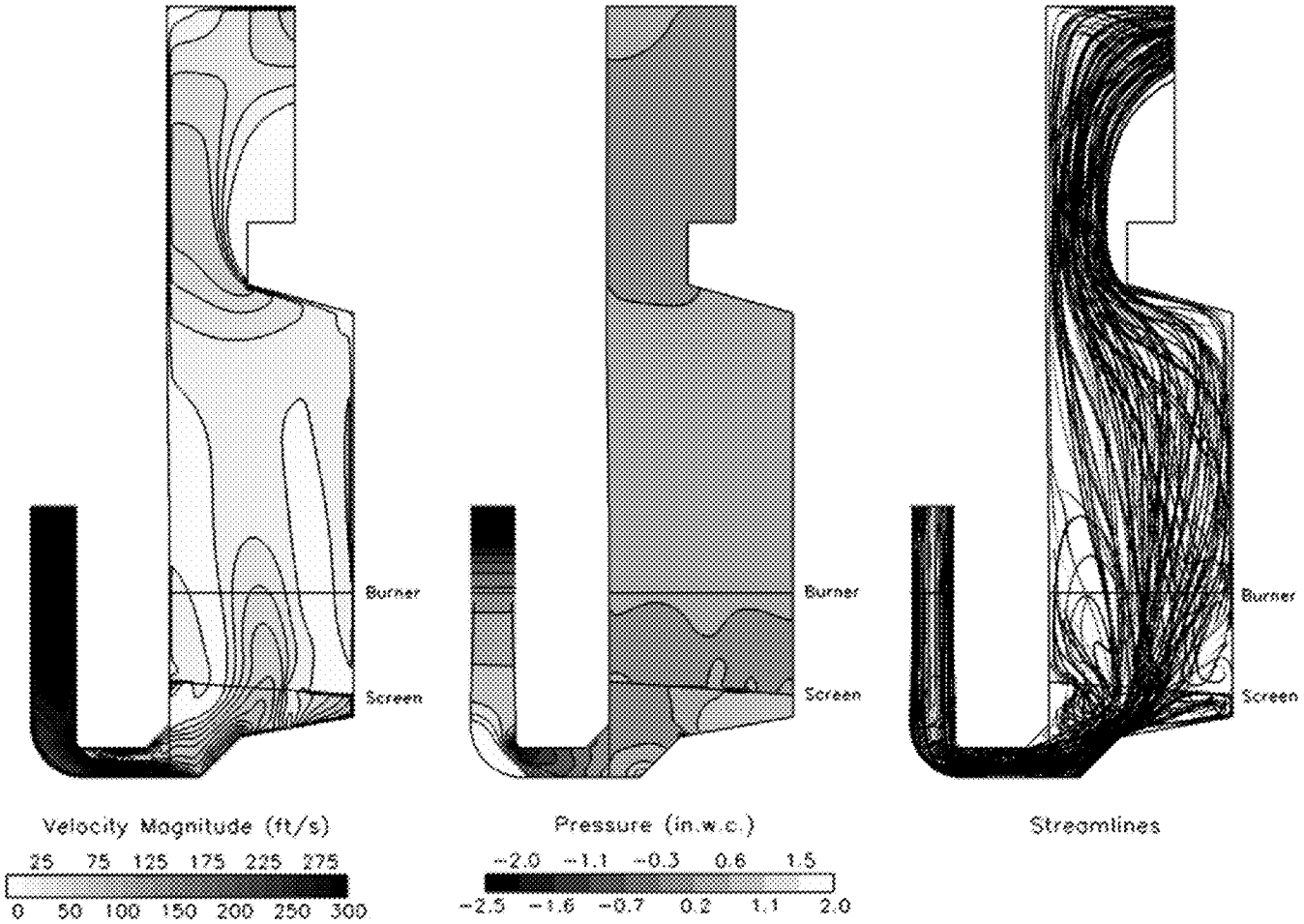
FIG. 6 shows computational fluid dynamic (CFD) models illustrating velocity magnitude, static pressure distributions, and fluid streamlines at the furnace center vertical plane at corresponding conditions for a CO boiler having a water cooled CO boiler floor with a screen gas distribution inlet according to the present disclosure.

FIG. 6 shows computational fluid dynamic (CFD) models illustrating velocity magnitude, static pressure distributions, and fluid streamlines at the furnace center vertical plane for a CO boiler having a water cooled CO boiler floor screen gas distribution inlet 110 according to the present disclosure. The velocity magnitude, static pressure distributions, and fluid streamlines are fairly well distributed at the furnace center vertical plane, and are expected to provide enhanced CO distribution and improved CO gas combustion.

It will thus be seen that several advantages over the prior art constructions are achieved by the present disclosure. The support of the water cooled CO boiler floor screen gas distribution inlet 110 and floor will be integrated. The water cooled CO boiler floor screen gas distribution inlet 110 screen does not have to have support beams as it is supported by the front wall intersection and support beams under the floor and knee region.

The embodiments depicted in FIGS. 1-6 are intended to illustrate in a non-limiting way to the ordinarily skilled artisan the breadth and scope of potential various embodiments of the present invention that may be adapted to various CO boiler designs. If desired, additional turning vane features may be incorporated into the tube erosion shields to further enhance the distribution of the incoming CO gas into the furnace. The water cooled CO boiler floor with screen gas distribution inlet uses integral pressure parts (tubes of the steam generator wall) as a flow straightener device via the water cooled CO boiler floor screen gas distribution inlet 110, gas tight membrane enclosure, and knee for redirecting flow to create the uniform gas distribution for more complete burning of the CO waste gas. The water cooled CO boiler floor screen gas distribution inlet 110 can be comprised simply of spaced, straight, parallel tubes or it can incorporate particularly shaped ports made of bent tubes. By integrating the nose and rear wall geometry, decreased gas flowing at high velocity across the front and rear wall is achieved. This is important to control both erosion and the heat transfer coefficients on the vertical walls, and is a novel application of hot gas on the back side of a furnace floor/screen to control flow rather than to control temperature.

The present disclosure has been described with reference to exemplary embodiments, it will be understood that it is not intended that the present invention be limited thereto Obviously, modifications and alterations will occur to others upon reading and understanding the preceding detailed description. In some embodiments of the invention, certain features of the invention may sometimes be used to advantage without a corresponding use of the other features. It is intended that the present disclosure be construed as including all such modifications and alterations insofar as they come within the scope of the appended claims or the equivalents thereof.

The invention claimed is:

1. A carbon monoxide (CO) boiler, comprising:

a furnace enclosure having front, rear and side walls, a water cooled CO boiler floor with a screen gas distribution inlet, and a knee located below the floor;

a CO gas conduit for conveying CO gas into the furnace enclosure; and a furnace arch located at a transition region between a lower furnace portion of the boiler and an upper furnace portion of the boiler, the furnace arch serving to redirect gases from the lower furnace portion across heating surfaces located in the upper furnace portion;

wherein the front wall, the water cooled CO boiler floor with the screen gas distribution inlet, and the knee are formed from a set of tubes, each tube having a front wall portion, a floor portion, and a knee portion;

wherein the floor portions of the tubes are separated from one another and are without membranes therebetween to form an integral screen having an arrangement of gaps or apertures between adjacent tubes for conveying CO gas therethrough into the furnace enclosure;

wherein membranes are present between the knee portions of the tubes for redirecting incoming CO gas upwardly through the integral screen into the furnace enclosure;

wherein membranes are present between the front wall portions of the tubes; and wherein the CO gas conduit is located so incoming CO gas impacts the knee.

2. The CO boiler according to claim 1, comprising at least one fuel burner for combusting supplementary fuel with air in the furnace enclosure, wherein the supplementary fuel supplementing primary CO fuel.

3. The CO boiler according to claim 1, comprising tube erosion shields provided on the floor portion of each tube forming the water cooled CO boiler floor with the screen gas distribution inlet.

4. The CO boiler according to claim 1, wherein each tube extends from the knee portion towards the rear wall and bends at a nose portion, each tube then extends from the nose portion to the floor portion, and each tube then extends from the floor portion to the front wall portion, wherein the water cooled CO boiler floor with the screen gas distribution inlet is formed via the floor portions of the tubes.

5. The CO boiler according to claim 1, wherein the water cooled CO boiler floor with the screen gas distribution inlet is supported by a front wall intersection and support beams under the floor and knee.

6. The CO boiler according to claim 1, wherein the floor portion of each tube used to form the water cooled CO boiler floor with the screen gas distribution inlet is substantially planar.

7. The CO boiler according to claim 1, wherein the floor portions of the tubes that are used to form the water cooled CO boiler floor with the screen gas distribution inlet are staggered out of plane with respect to one another.

8. The CO boiler according to claim 2, further comprising:

a forced-draft fan for providing combustion air;

a duct for conveying combustion air to a windbox; and wherein one or more burners are located in the windbox for combining the combustion air with the supplementary fuel for combustion in the furnace enclosure.

9. The CO boiler according to claim 8, further comprising:

a shut-off damper and a control damper located between the forced draft fan and duct for controlling the flow of combustion air into the windbox.

10. The CO boiler according to claim 3, wherein each tube erosion shield is attached to a given tube by a bar that is attached to sides of the tube erosion shields and the underside of the given tube.

* * * * *